US011391282B2

(12) United States Patent
Keber et al.

(10) Patent No.: US 11,391,282 B2
(45) Date of Patent: Jul. 19, 2022

(54) AXIAL VENTILATOR HAVING NOISE REDUCING FAN WHEEL BLADES

(71) Applicant: ebm-papst St. Georgen GmbH & Co. KG, St. Georgen (DE)

(72) Inventors: Roland Keber, Worth (DE); Tobias Sieger, Geisingen (DE); Wolfgang Laufer, Aichhalden (DE); Jürgen Herr, St. Georgen (DE); Arnold Schulde, VS-Schwenningen (DE); Georg Eimer, St. Georgen (DE); Martin Müller, Freudenstadt (DE); Dominik Haas, Hardt (DE); Simon Hoppe, St. Georgen (DE); Julien Grilliat, Villingen-Schwenningen (DE); Johannes Dannecker, Schonach (DE); Clemens Günter, Schramberg (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 121 days.

(21) Appl. No.: 16/798,824

(22) Filed: Feb. 24, 2020

(65) Prior Publication Data

US 2020/0277962 A1 Sep. 3, 2020

(30) Foreign Application Priority Data

Feb. 28, 2019 (DE) ..... 10 2019 105 190.8

(51) Int. Cl.

| | |
|---|---|
| ***F04D 29/38*** | (2006.01) |
| ***F04D 19/00*** | (2006.01) |
| ***F04D 29/52*** | (2006.01) |

(52) U.S. Cl.
CPC ..... *F04D 19/002* (2013.01); *F04D 29/388* (2013.01); *F04D 29/522* (2013.01)

(58) Field of Classification Search
CPC .... F04D 19/002; F04D 29/522; F04D 29/667; F04D 29/388; F04D 19/005;
(Continued)

(56) References Cited

U.S. PATENT DOCUMENTS

D897,520 S * 9/2020 Gebert ..... D23/370
D903,085 S * 11/2020 Gebert ..... D23/370
(Continued)

FOREIGN PATENT DOCUMENTS

CN 107313979 A 11/2017
CN 107489658 A 12/2017
(Continued)

OTHER PUBLICATIONS

German Search Report (in German) dated Dec. 5, 2019 in corresponding German Application No. 10 2019 105 190.8.
(Continued)

*Primary Examiner* — Aaron R Eastman
(74) *Attorney, Agent, or Firm* — Harness, Dickey & Pierce, P.L.C.

(57) ABSTRACT

An axial ventilator (1) has a housing (2) and a fan wheel (3) arranged in the housing (2) to generate an axial air flow through the housing (2). The fan wheel (3) has multiple fan wheel blades (4) that extend radially outward from a hub (5) up to a respective blade tip (8). The blades extend spaced apart from an inner wall of the housing (2) via a head gap (12). The fan wheel blades (4) have boreholes (7) along the respective blade tip (8).

16 Claims, 3 Drawing Sheets

(58) Field of Classification Search
CPC .... F04D 29/681; F04D 29/666; F04D 29/663; F05D 2240/307; F05D 2260/962; F05D 2210/12
See application file for complete search history.

(56) References Cited

U.S. PATENT DOCUMENTS

| | | | | |
|---|---|---|---|---|
| 11,073,157 | B2 * | 7/2021 | Gallagher | F02C 7/36 |
| 2005/0186070 | A1 * | 8/2005 | Zeng | F04D 29/544 415/211.2 |
| 2010/0150731 | A1 * | 6/2010 | Zhang | F04D 29/681 416/90 R |
| 2010/0329848 | A1 | 12/2010 | Harvey et al. | |
| 2012/0100001 | A1 | 4/2012 | Chen | |
| 2021/0246909 | A1 * | 8/2021 | Kim | F04D 29/522 |

FOREIGN PATENT DOCUMENTS

| | | | |
|---|---|---|---|
| DE | 37 16 718 | A1 | 11/1987 |
| DE | 10 2008 052 981 | A1 | 4/2010 |
| DE | 10 2014 102 311 | A1 | 8/2015 |
| JP | H11-201090 | A | 7/1999 |
| JP | 2005-240749 | A | 9/2005 |

OTHER PUBLICATIONS

European Search Report dated Jun. 29, 2020 in corresponding European Application No. 20155642.0.

* cited by examiner

AXIAL VENTILATOR HAVING NOISE REDUCING FAN WHEEL BLADES

CROSS-REFERENCE TO RELATED APPLICATION

This application claims priority to German Application No. 10 2019 105 190.8, filed Feb. 28, 2019. The disclosure of the above application is incorporated herein by reference.

FIELD

The disclosure relates to an axial ventilator having a housing and a fan wheel arranged in the housing to generate an axial airflow through the housing.

BACKGROUND

In axial ventilators, with ring-shaped housings enclosing the fan wheel, head gap turbulence arises at the head gap between the fan wheel blades and the housing inner wall. This results in practice, in significant noise development. There are already multiple approaches for the noise reduction in the prior art. However, these are not suitable for every use. For example, the diameter of the axial ventilator can be enlarged. However, this is counterproductive with respect to its efficiency and wind load behavior. Alternatively, there is the option of influencing the inflow or outflow, however, additional components usually add an increased structural space requirement that is necessary for this purpose.

SUMMARY

The disclosure is based on the object of improving the noise behavior of an axial ventilator.

This object is achieved by an axial ventilator with a housing and a fan wheel arranged in the housing to generate an axial air flow through the housing. The fan wheel comprises multiple fan wheel blades. The blades extend radially outward from a hub up to the respective blade tip. The blades extend spaced apart over a head gap from an inner wall of the housing. The fan wheel blades comprise boreholes along the respective blade tip.

According to the disclosure, an axial ventilator, with a housing and a fan wheel arranged in the housing, for generating an axial airflow through the housing is proposed. The fan wheel comprises multiple fan wheel blades that extend from a hub radially outward up to the respective blade tip. The blades extend spaced apart, via a head gap, to an inner wall of the housing. The blade tip is the extension of the fan wheel blades along the inner wall of the housing. This encloses the fan wheel as a housing ring. The fan wheel blades comprise boreholes along the respective blade tip.

In operation, the boreholes along the respective blade tip interact directly with the head gap turbulence and reduce the noise emission of the fan wheel. In particular, the shape and propagation of the flow turbulence along the blade tips of the fan wheel blades is favorably influenced. In axial ventilators that differ exclusively by way of the fan wheel blades, with and without boreholes provided along the blade tip, it was possible to achieve reductions of the noise development by greater than 20% in measurements.

The boreholes have particularly advantageous effects in axial ventilators where the fan wheel blades have a very flat angle of attack in relation to the axial plane extending perpendicularly to the flow direction. The angle is in particular in the range of 5-25°, preferably 10-20°.

One refinement of the axial ventilator includes the boreholes formed on both axial sides of the fan wheel blades. In one preferred embodiment, the boreholes are formed as through boreholes through the fan wheel blades.

Preferably, a plurality of boreholes per fan wheel blade are provided along the respective blade tip. The number of the boreholes is at least two, but in particular at least three, preferably at least five, more preferably at least seven. The boreholes extend in this case along a line parallel to the blade tip. The arrangement is thus established via the profile of the blade tip along the head gap in relation to the inner wall of the housing.

An embodiment of the boreholes having a circular cross section has proven to be particularly advantageous. The size of the boreholes is defined via its diameter. In one advantageous embodiment of the axial ventilator, the boreholes have a maximum diameter DBmax, that corresponds to 0.7-1.5%, preferably 1% of a maximum fan wheel diameter of the fan wheel.

A special arrangement of the boreholes in relation to one another also promotes the noise reduction. An embodiment variant is favorable where the boreholes have a distance A, that corresponds to twice the maximum diameter DBmax of the boreholes, along the respective blade tip in relation to one another. The distance A is measured in each case at the center point of the respective borehole. In relation to the maximum fan wheel diameter D of the fan wheel, the distance A of the boreholes in relation to one another along the respective blade tip is advantageous if it corresponds to 2% of the maximum fan wheel diameter D.

Furthermore, it is advantageous that the boreholes are spaced apart somewhat radially inward from the respective blade tip of the respective fan wheel blade. Accordingly, they are nonetheless adjoining. Thus, the radial outer blade tip of the respective fan wheel blade extends continuously and uninterruptedly. One advantageous embodiment with respect to the noise generation includes the boreholes with a maximum diameter DBmax and are spaced apart from the respective blade tip over a radial length LS, so that the following applies: $DBmax \leq LS \leq 2.5 \times DBmax$. Particularly preferably, $LS = 1.5 \times DBmax$. In other words, the boreholes are preferably offset radially inward from the blade tip by 1.5 times the borehole diameter. Measurement is also always performed here in the center point of the boreholes.

In relation to the maximum fan wheel diameter D of the fan wheel, the length LS, over which the boreholes are spaced apart from the respective blade tip, preferably corresponds to 1.5% of the maximum fan wheel diameter D of the fan wheel.

Preferably, all boreholes of the fan wheel are each formed identically with respect to shape and size.

In one advantageous embodiment variant of the axial ventilator, the boreholes are arranged over an extension along the blade tip of the respective fan wheel blade that corresponds to 10-40% of the maximum extension of the blade tip along the head gap. This means that there is a predominant section along the blade tip where no boreholes are provided, but a minimum quantity and a minimum extension are not to be undershot. Furthermore, it is advantageous to arrange the boreholes in a region of the blade tip that adjoins the respective blade front edge and/or respective blade rear edge. If the fan wheel blades extend radially indented in the transition region from the blade tip to the blade front edge or respective blade rear edge and a head gap to the housing no longer exists in this section, boreholes can nonetheless also be provided in this section along the blade tip.

In one advantageous embodiment variant, the axial ventilator moreover provides that each of the fan wheel blades comprises a middle section. The middle section is free of boreholes along the blade tip and adjoining a radial center line of the fan wheel blades on both sides. The boreholes are thus provided in a region of the front edge and/or rear edge of the fan wheel blades. The middle section preferably defines 20-90%, more preferably 40-80% of the maximum extension of the respective fan wheel blade in the circumferential direction.

In one refinement of the axial ventilator, the boreholes are additionally provided along a front edge and/or a rear edge of the fan wheel blades. The distances in relation to one another or in relation to the front edge and/or a rear edge preferably correspond in this case to those of the boreholes along the blade tip or in relation to the blade tip.

Furthermore, an embodiment is favorable where, in the axial ventilator, the respective number of the boreholes along the front edge and/or the rear edge of the fan wheel blades is additionally less than or equal to the number of boreholes along the blade tip. This means that the number of the boreholes on the front edge and on the rear edge is always not greater in each case than the number of the boreholes on the blade tip.

In one embodiment, the axial ventilator includes the fan wheel designed as reversible. Its flow direction generated in operation is dependent on its rotational direction. The boreholes are then preferably provided both on the front edge and also the rear edge and on both axial sides of the respective fan wheel blades.

DRAWINGS

Other advantageous refinements of the disclosure are characterized in the dependent claims and/or are described in greater detail hereafter together with the description of the preferred embodiment of the disclosure on the basis of the figures. In the figures:

DETAILED DESCRIPTION

Figure 1:
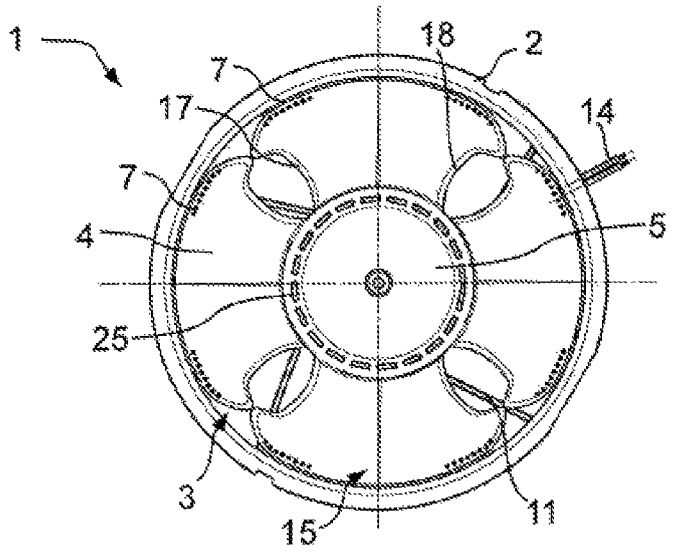
FIG. 1 is a top plan view of a first embodiment of an axial ventilator.
Figure 2:
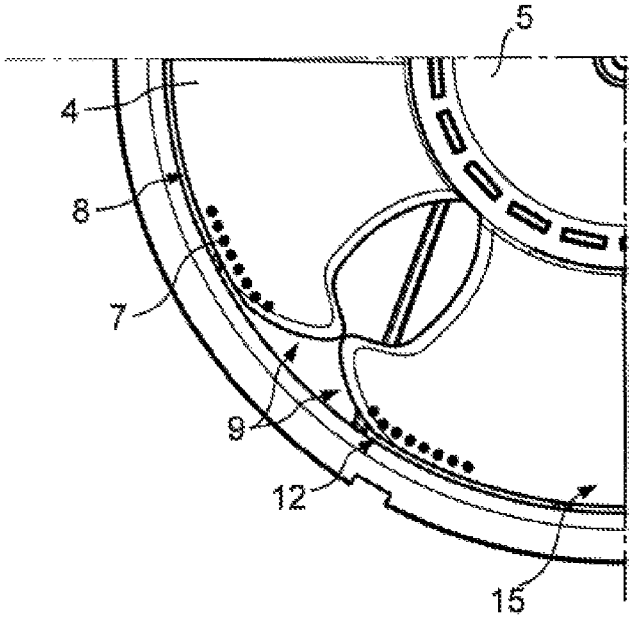
FIG. 2 is an enlarged detail view of the axial ventilator from FIG. 1.
Figure 3:
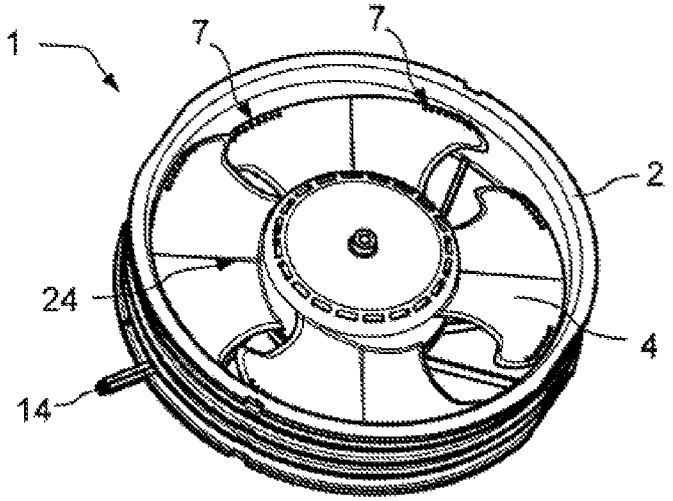
FIG. 3 is a perspective front view of the axial ventilator from FIG. 1.
Figure 4:
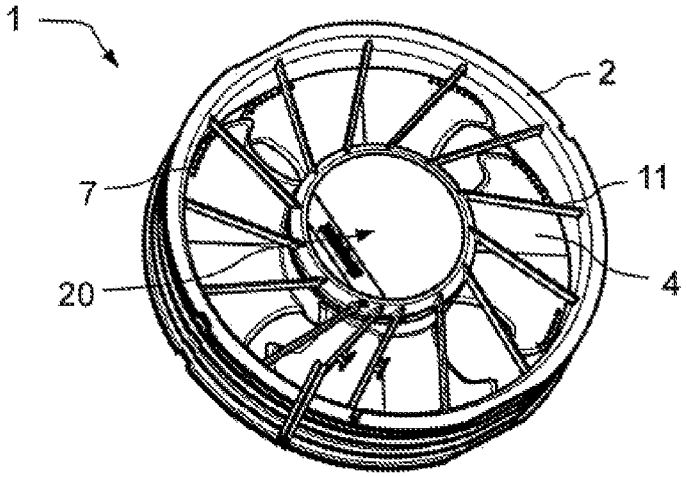
FIG. 4 is a perspective rear view of the axial ventilator from FIG. 1.

A first embodiment variant of the axial ventilator 1 is shown in FIGS. 1-4. It has a ring-shaped closed housing 2 and a reversibly designed fan wheel 3. The fan wheel 3 generates the axial airflow. The air flow direction is dependent on the rotational direction of the fan wheel 3. The fan wheel 3 includes hub 5 with multiple ventilation openings 25 arranged in a circular shape. The drive motor is accommodated in the hub 5. The motor is electrically supplied via the terminals 14.

On the rear side, the drive motor is held by the holder 20. The holder 20 is connected to the housing 2 via webs 11 arranged distributed in the circumferential direction. The webs 11 extend linearly but are inclined in relation to a radial plane.

The fan wheel blades 4 extend radially outward from the hub 5 up to the respective blade tip 8. The blade tip 8 forms the blade edge adjacent the inner wall of the housing 2. The head gap 12 is provided between the blade tips 8 and the inner wall of the housing 2, so that the fan wheel 3 can rotate in relation to the housing 2. The fan wheel blades 4 are each formed identically. Each blade tip 8 has a radially indented section 9 on both sides viewed in the circumferential direction. Here, the blade edge still does face radially outward but is spaced apart from the inner wall of the housing 2. Adjoining this, the blade edge merges into the front edge 17 and rear edge 18. The blade tips 8 each face in the circumferential direction, but are each formed indented in the circumferential direction in relation to the radial outermost section of the fan wheel blades 4.

Along the respective center axis, viewed in the circumferential direction, an axial step 24 is formed on each of the fan wheel blades 4. The step 24 enlarges viewed radially inward and runs out toward the blade tip 8. Thus, a continuous profile of the fan wheel blade 4 is provided in the region of the blade tip 8.

A plurality of boreholes 7, with circular cross section, are provided on each of the fan wheel blades 4 along the respective blade tip 8. The boreholes 7 are formed at the respective identical position on both axial sides. Thus, they have the respective identical center axis. It is preferably provided that the boreholes 7 are formed as through boreholes.

In the embodiment according to FIGS. 1-4, eight boreholes 7 are provided on both end sections facing toward the front edge 17 and toward the rear edge 18 along the blade tip 8. Thus, a total of 16 boreholes 7 per fan wheel blade 4. Per the region having boreholes 7, respectively, six boreholes 7 are located along the blade tip 8 along the head gap 12 and, respectively, two boreholes 7 are located in the indented region 9.

Figure 5:
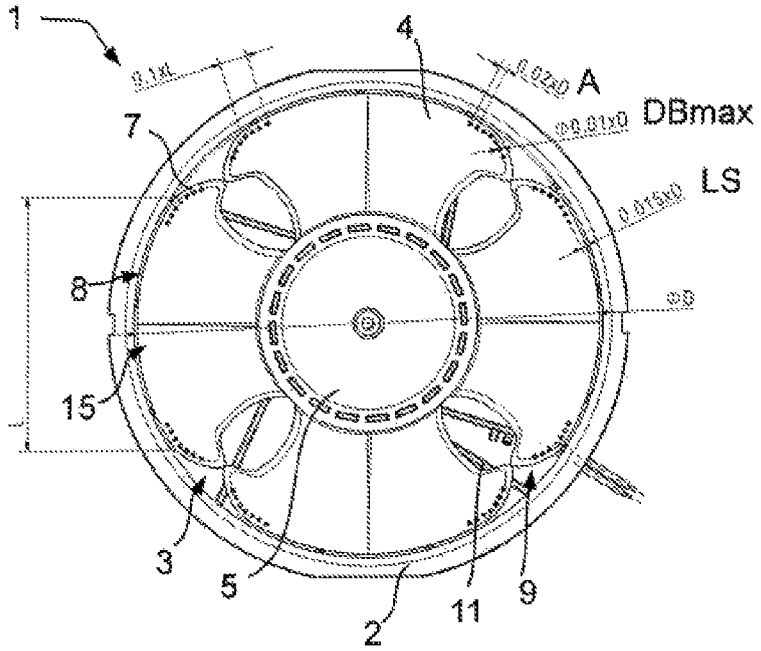
FIG. 5 is a top plan view of a second embodiment of an axial ventilator.

In the embodiment according to FIG. 5, only seven boreholes 7 are provided in each case on the respective end sections along the blade tip 8. Thus, a total of 14 boreholes 7 per fan wheel blade 4. In relation to the embodiment according to FIGS. 1-4, in the embodiment according to FIG. 5, the boreholes 7 are displaced further outward viewed in the circumferential direction. Thus, four of the seven boreholes 7 are located, respectively, along the blade tip 8 along the head gap 12 and, respectively, three boreholes 7 are located in the indented section 9. Otherwise, the embodiments according to FIGS. 1-4 and FIG. 5 are identical.

Although it is not shown in the two embodiments, corresponding boreholes 7 can also be provided in the region of the front edge 17 or the rear edge 18 and also both on the front edge 17 and also the rear edge 18 of the respective fan wheel blades 4. The number of the boreholes, respectively, along the front edge 17 or the rear edge 18 is established as less than that of the radial outer edge.

Each of the fan wheel blades 4 comprises a middle section 15, which is free of boreholes 7, along the blade tip 8. The middle section 15 adjoins a radial center line of the fan wheel blades 4 on both sides. The middle section 15 without boreholes 7 defines, in both embodiments according to FIGS. 1 and 5, the comparatively larger region. Thus, over a greater extension of the respective fan wheel blade 4, no boreholes 7 are provided. The boreholes 7 are essentially located in the circumferential edge sections.

In both embodiments of FIGS. 1 and 5, the fan wheel blades 4 have a very small angle of attack of less than 25° in relation to the axial plane extending through the housing 2. This can be seen well in FIG. 3. In the case of such small angles of attack, the boreholes 7 are particularly effective.

The size, shape, and arrangement of the boreholes 7 significantly influences the noise-reducing effect. Advantageous dimensions are recorded in FIG. 5, which are also identically applicable to the exemplary embodiment of FIGS. 1-4. The boreholes 7 have a maximum diameter Dbmax. It corresponds to 1% of the maximum fan wheel diameter D of the fan wheel 4, measured in each case in the center point of the boreholes 7.

The distance A of the boreholes 7 in relation to one another along the respective blade tip 8 corresponds to twice the maximum diameter DBmax and 2% of the maximum fan wheel diameter D of the fan wheel 4. The boreholes 7 are spaced apart from the blade tip 8 over the length LS. This makes up 1.5% of the fan wheel diameter D and 1.5 times the maximum diameter DBmax.

The radial outer blade tip 8 of the respective fan wheel blade 4 extends continuously and uninterruptedly. According to the embodiment in FIG. 5, the distribution of the boreholes 7 along the blade tip 8 is performed over a length which corresponds to 10% of the blade tip length L, along which the head gap 12 is formed. In the embodiment according to FIGS. 1-4, it is 20%.

In both embodiments according to FIGS. 1-4 and 5, all boreholes 7 are each formed identically. Alternatively, however, it can also be provided that the boreholes 7 differ in relation to one another in shape and size.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An axial ventilator comprising:

a housing and a fan wheel arranged in the housing for generating an axial air flow through the housing;

the fan wheel comprises multiple fan wheel blades extending radially outward from a hub up to a respective blade tip, the blades extend spaced apart over a head gap from an inner wall of the housing, each blade tip includes a front edge and a rear edge; and the fan wheel blades comprise boreholes at the front edge and at the rear edge along the respective blade tip.

2. The axial ventilator according to claim 1, wherein the fan wheel blades have a small angle of attack in relation to an axial plane in the range of 5-25°.

3. The axial ventilator according to claim 1, wherein the boreholes are formed on both axial sides of the fan wheel blades.

4. The axial ventilator according to claim 1, wherein the boreholes are formed as through boreholes through the fan wheel blades.

5. The axial ventilator according to claim 1, wherein a number of the boreholes per fan wheel blade along the respective blade tip is at least two and wherein the boreholes are arranged along a line parallel to the blade tip.

6. The axial ventilator according to claim 1, wherein the boreholes have a circular cross section.

7. The axial ventilator according to claim 6, wherein the boreholes have a maximum diameter DBmax that corresponds to 1% of a maximum fan wheel diameter D of the fan wheel.

8. The axial ventilator according to claim 7, wherein the boreholes have a distance A in relation to one another along the respective blade tip that corresponds to twice the maximum diameter DBmax, wherein the distance is measured in each case at the center point of the respective borehole.

9. The axial ventilator according to claim 1, wherein the boreholes have a distance A in relation to one another along the respective blade tip, which corresponds to 2% of a maximum fan wheel diameter D of the fan wheel.

10. The axial ventilator according to claim 1, wherein the boreholes have a maximum diameter DBmax and are spaced apart from the respective blade tip over a length LS, so that the following applies: $DBmax \leq LS \leq 2.5 \times DBmax$.

11. The axial ventilator according to claim 1, wherein the boreholes are spaced apart from the respective blade tip over a length LS which corresponds to 1.5% of a maximum fan wheel diameter D of the fan wheel.

12. The axial ventilator according to claim 1, wherein the boreholes are provided over an extension along the blade tip of the respective fan wheel blade that corresponds to 10-40% of a maximum extension of the blade tip along the head gap.

13. The axial ventilator according to claim 1, wherein a respective number of the boreholes additionally along the front edge and/or the rear edge of the fan wheel blades is less than or equal to a number of boreholes along the blade tip.

14. The axial ventilator according to claim 1, wherein each of the fan wheel blades comprises a middle section, that is free of boreholes, along the blade tip and the middle section adjoins a radial center line of the fan wheel blades on both sides, the middle section defines 20-90% of an extension of the respective fan wheel blade in the circumferential direction.

15. The axial ventilator according to claim 1, wherein the fan wheel is designed to be reversible and its flow direction generated in operation is dependent on its rotational direction.

16. The axial ventilator according to claim 1, wherein the fan wheel blades have a small angle of attack in relation to an axial plane in the range of 10-20°.

* * * * *